US008992258B2

(12) United States Patent
Raschilla et al.

(10) Patent No.: US 8,992,258 B2
(45) Date of Patent: Mar. 31, 2015

(54) ELECTRICAL CABLE CONNECTOR SHIELD WITH POSITIVE RETENTION LOCKING FEATURE

(71) Applicant: Delphi Technologies, Inc., Troy, MI (US)

(72) Inventors: Anthony Raschilla, Girard, OH (US); John L. Wicks, Cortland, OH (US); Troy A. Iler, Salem, OH (US)

(73) Assignee: Delphi Technologies, Inc., Troy, MI (US)

( * ) Notice: Subject to any disclaimer, the term of this patent is extended or adjusted under 35 U.S.C. 154(b) by 104 days.

(21) Appl. No.: 13/871,210

(22) Filed: Apr. 26, 2013

(65) Prior Publication Data

US 2014/0322976 A1 Oct. 30, 2014

(51) Int. Cl.
*H01R 13/648* (2006.01)

(52) U.S. Cl.
CPC ..... *H01R 13/648* (2013.01)
USPC ..... 439/607.55

(58) Field of Classification Search
USPC ..... 439/607.55, 660, 131, 607.48, 108, 439/607.49
See application file for complete search history.

(56) References Cited

U.S. PATENT DOCUMENTS 4,619,496 A * 10/1986 Forney et al. ..... 439/434
5,962,812 A 10/1999 Miyazaki et al.
6,015,315 A * 1/2000 Ensign et al. ..... 439/578
6,088,417 A 7/2000 Jax et al.
6,409,534 B1 6/2002 Weisz-Margulescu
7,327,585 B1 * 2/2008 Fan et al. ..... 361/816
7,510,433 B2 3/2009 Blakborn et al.
7,561,444 B2 * 7/2009 He ..... 361/818
7,598,455 B2 10/2009 Gump et al.
7,695,318 B1 * 4/2010 Wang et al. ..... 439/607.01
7,815,446 B2 * 10/2010 Yang ..... 439/131
7,868,251 B2 * 1/2011 Gladd et al. ..... 174/72 A
8,323,055 B2 * 12/2012 Plate et al. ..... 439/578
8,500,494 B2 * 8/2013 Wu ..... 439/660
8,696,383 B2 * 4/2014 Do ..... 439/607.35
2009/0126985 A1 * 5/2009 Aoki et al. ..... 174/377
2011/0123159 A1 * 5/2011 Little et al. ..... 385/77
2012/0034817 A1 2/2012 Plate et al.
2012/0100746 A1 * 4/2012 Wu ..... 439/474
2012/0302104 A1 * 11/2012 Wu ..... 439/660
2013/0084746 A1 * 4/2013 Siahaan et al. ..... 439/607.41

* cited by examiner

*Primary Examiner* — Alexander Gilman
(74) *Attorney, Agent, or Firm* — Robert J. Myers

(57) ABSTRACT

A shielded, or coaxial, electrical cable assembly including a female shield connected to the outer conductor, or shield, of the cable. The female shield is configured to mate with a male shield to maintain the continuity of the shield in a connection. The male shield includes a flexible protrusion that is designed to align with and snap into an aperture defined in the female shield, thereby providing a mechanical connection between the male and female shields. The male shield also defines a flexible contact adapted to closely engage an interior surface of the female exterior shield, thereby providing an electrical connection between the male and female shields. The flexible protrusion and the flexible contact flex along axes that are generally orthogonal to one another so the flexible contact interacts with the female exterior shield substantially independently of the flexible protrusion.

8 Claims, 4 Drawing Sheets

ELECTRICAL CABLE CONNECTOR SHIELD WITH POSITIVE RETENTION LOCKING FEATURE

TECHNICAL FIELD OF THE INVENTION

The invention generally relates to electrical cable assembly, and more particularly relates to an electrical cable assembly having a connector shield with a positive retention locking feature.

BACKGROUND OF THE INVENTION

Applications are arising in the automotive industry that require the use of shielded, e.g. coaxial, electrical cables. These cables may be used for high voltage power transmission as well as digital data transmission within the vehicle. Connecting these shielded cables necessitates connecting the inner core conductors as well as the outer sheath (shield) conductors.

U.S. Pat. No. 8,323,055 issued to Plate, et. al. on Dec. 4, 2012 and U.S. Pat. No. 7,868,251 issued to Gladd, et. al. on Jan. 11, 2011 show an electrical cable assembly that includes a connector that is configured to electrically connect both the inner core and the outer sheath of a shielded cable. The connector includes a female shield that is connected to the outer sheath and a male shield that is configured to mate with the female shield. It has been observed by the inventors that mechanical shock and vibration experienced by these types of connectors in an automotive environment may cause fretting corrosion between the male and female shields. A shielded electrical cable assembly capable of withstanding the shock and vibration profile of an automobile without experiencing fretting corrosion is therefore desired.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical cable assembly is provided. The electrical cable assembly includes an electrical cable having an inner core and a surrounding outer sheath each running the length of the electrical cable. The electrical cable assembly also includes a female exterior shield that is connected to the outer sheath at a closed end. The female exterior shield has an open end that is defined about a central axis. The female exterior shield defines an aperture having an aperture axis that is generally perpendicular to the central axis. The electrical cable assembly further includes a male exterior shield that is adapted to be connected to the female exterior shield. The male exterior shield is sized to fit within the open end of the female exterior shield. The male exterior shield defines a flexible contact that is adapted to closely engage an interior surface of the female exterior shield, thereby providing an electrical connection between the two shields. The male exterior shield additionally defines a flexible protrusion that is designed to align with and snap into the aperture, thereby providing a mechanical connection between the two shields and forming a positive retention locking feature. The flexible protrusion and the flexible contact flex along axes that are generally orthogonal to one another so as to interact with the female exterior shield substantially independently of one another.

In accordance with another embodiment of this invention, the aperture is characterized as a generally circular hole in a side wall of the male exterior shield. The flexible protrusion includes a generally circular convex bump that is designed to align with and snap into the aperture and a flexible fixed beam on which the convex bump is disposed.

In accordance with yet another embodiment of this invention, the female exterior shield defines a pair of apertures, located one opposite the other, wherein the pair of apertures shares a common aperture axis. The male exterior shield likewise defines a pair of flexible protrusions designed to align with and snap into the pair of apertures. The male exterior shield defines a pair of flexible contacts located one opposite the other. The flexible protrusions and the flexible contacts flex along axes that are generally orthogonal to one another so as to interact with the female exterior shield substantially independently of one another.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

An electrical cable assembly is presented herein that includes a positive retention locking feature that is designed to inhibit relative motion between two interconnected shields.

Figure 1:
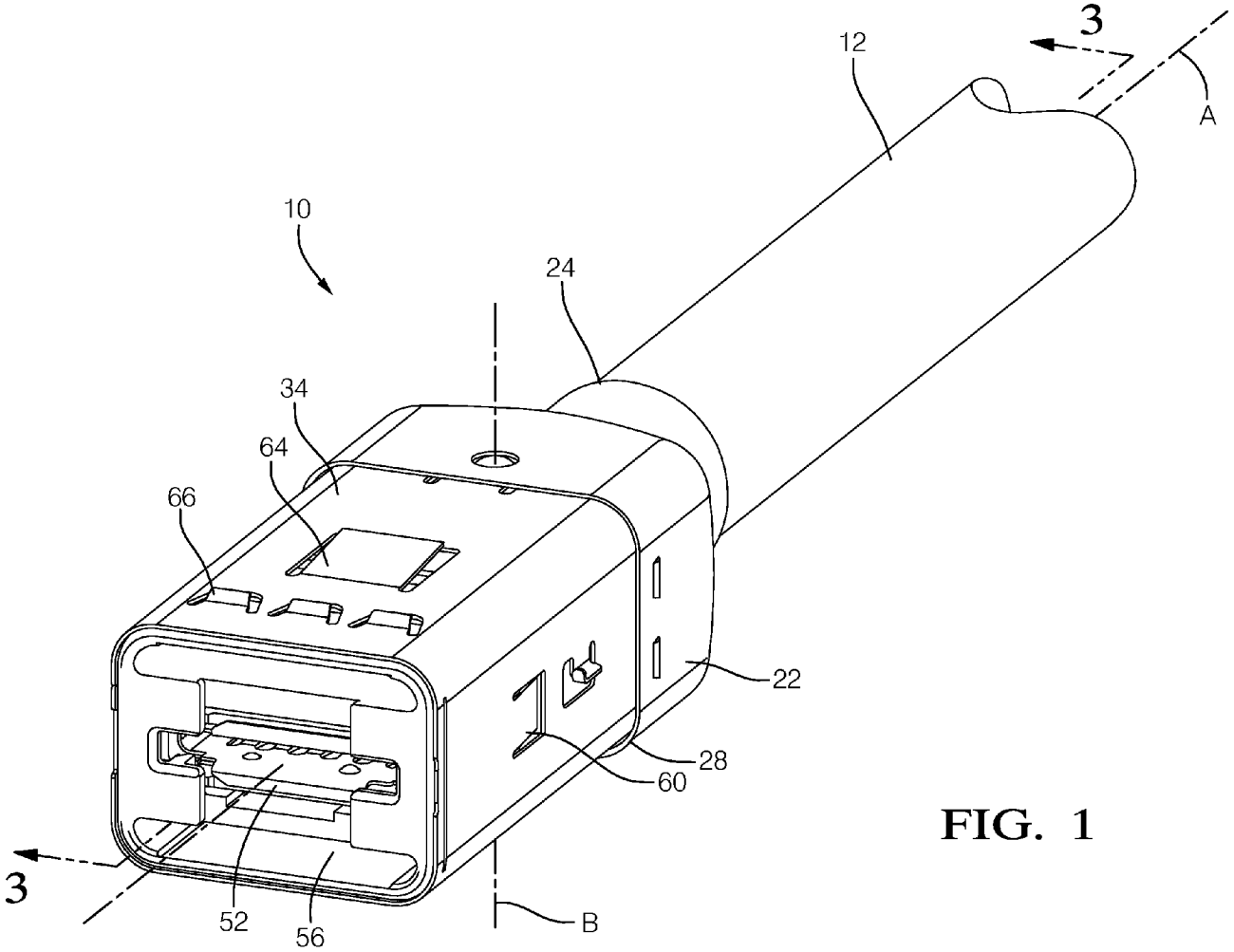
FIG. 1 is a perspective view of an electrical cable assembly in accordance with one embodiment.
Figure 2:
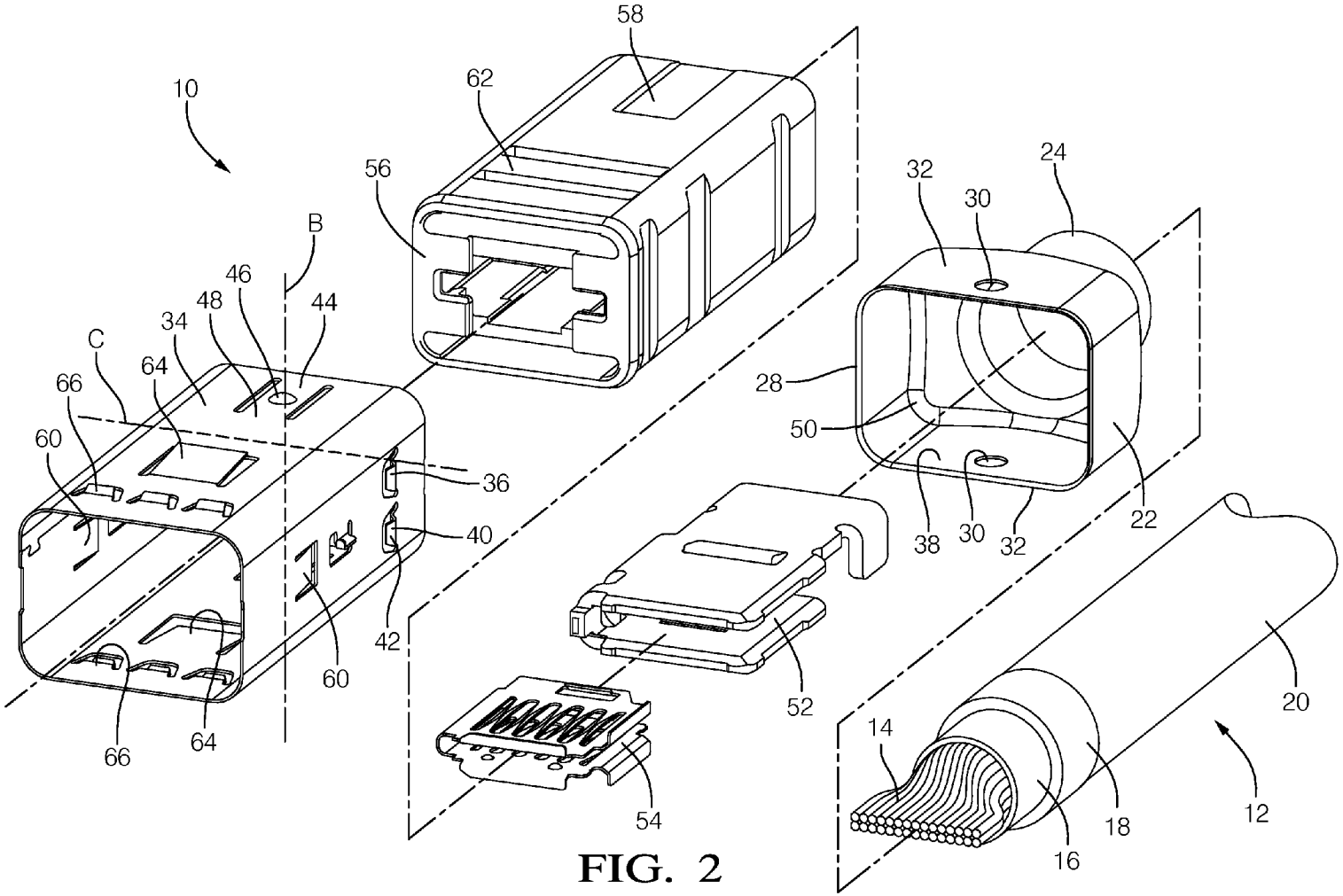
FIG. 2 is an exploded perspective view of the electrical cable assembly of FIG. 1 in accordance with one embodiment.
Figure 3:
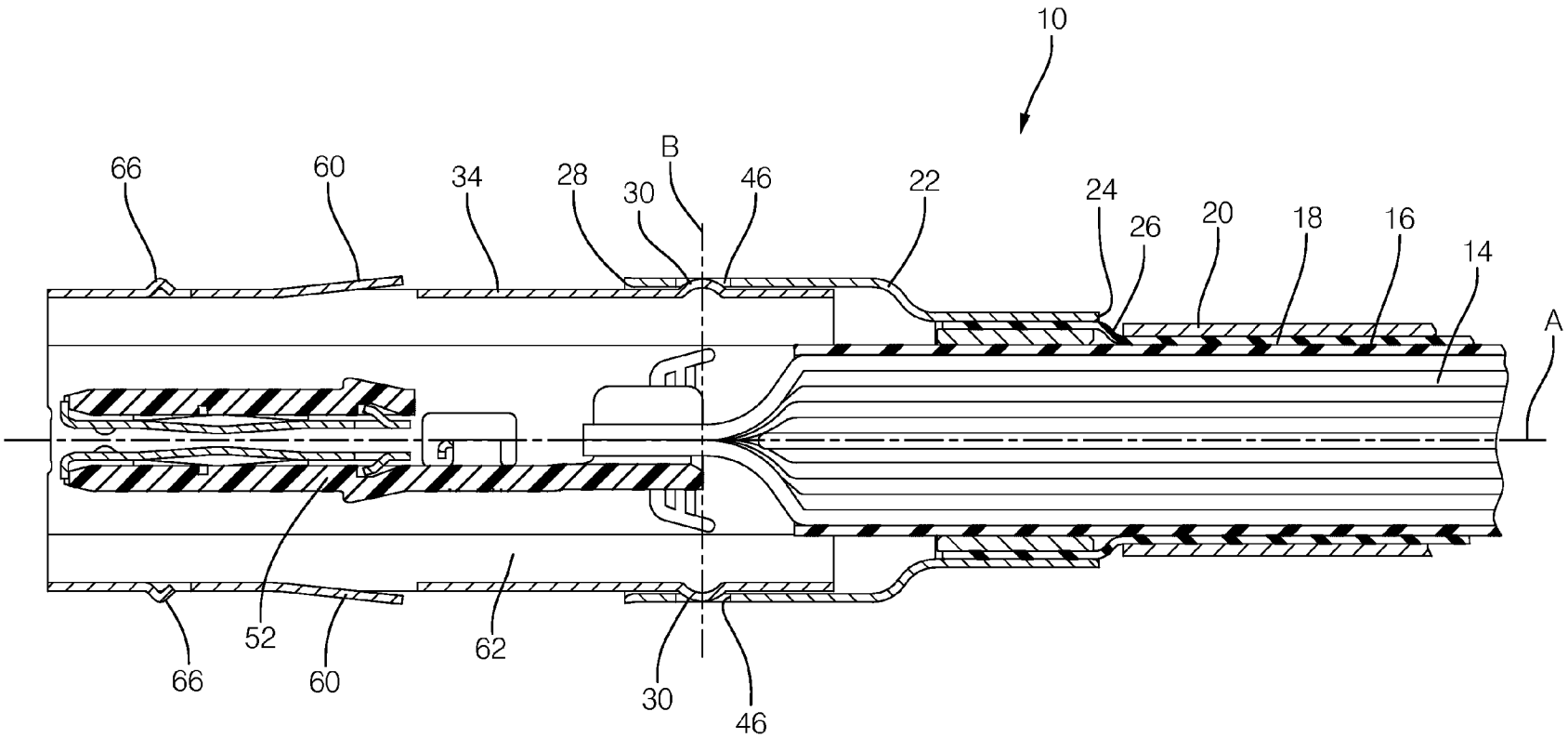
FIG. 3 is cross sectional side view of the electrical cable assembly of FIG. 1 in accordance with one embodiment.
Figure 4:
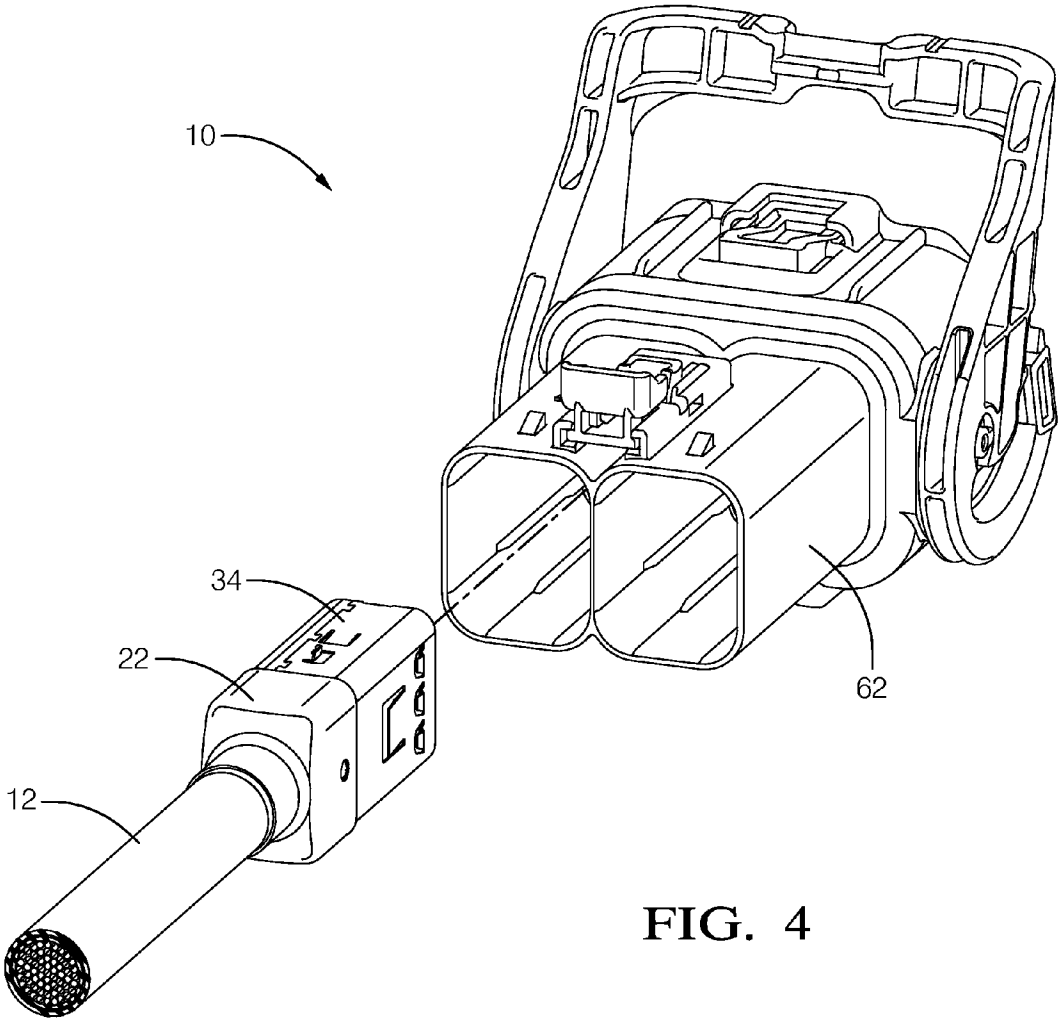
FIG. 4 is a partially exploded perspective view of an electrical cable assembly in accordance with another embodiment.

FIGS. 1-3 illustrate a non-limiting example of an electrical cable assembly 10, hereafter referred to as the assembly 10. The assembly 10 in the instant example is designed for use in a motor vehicle in a high voltage/high current application. The assembly 10 includes an electrical cable 12 having an electrically conductive inner core 14 this is surrounded by an inner insulation layer 16 formed of a dielectric material. The inner core 14 is formed of multiple stands of a material having a relatively high conductivity, such as copper or aluminum. The inner insulation layer 16 is surrounded by an electrically conductive outer sheath 18 that is formed of woven strands of a material having a relatively high conductivity, such as copper or aluminum. The outer sheath 18 is itself surrounded by an outer insulation layer 20 formed of a dielectric material. The electrical cable 12 may be generally referred to as a coaxial cable or a shielded cable. The materials and methods used to construct shielded electrical cables are well known to those skilled in the art.

The assembly 10 also includes a female exterior shield 22, hereafter referred to as the female shield 22. The female shield 22 defines a first opening 24 about a central axis A that is connected to the outer sheath 18 of the electrical cable 12, thereby forming a closed end 24. The first opening 24 is crimped to the outer sheath 18 to form the closed end 24. As best shown in FIG. 3, the assembly 10 may also include a metallic ferrule 26 that is disposed between the first opening 24 and the outer sheath 18 prior to crimping the female shield 22 to the electrical cable 12. The ferrule 26 is configured to improve the mechanical and electrical connection between the female shield 22 and the electrical cable 12. The female shield 22 defines a second opening 28 about the central axis A, thereby forming an open end 28 of the female shield 22. The second opening 28 is generally larger than the first opening 24, and so the female shield 22 may be characterized as generally bell-shaped. The female shield 22 is formed of a metallic material, such as C425 copper alloy, using a deep draw stamping process to form a seamless shield. The female shield 22 may be plated, such as with a tin-based plating, to enhance corrosion resistance. As best shown in FIG. 2, the female shield 22 defines a pair of apertures 30, or holes 30 located one opposite the other in opposing side walls 32 of the female shield 22. The pair of apertures 30 shares an aperture axis B that is generally perpendicular to the central axis A of the female shield 22. The apertures 30 in the instant example are characterized as a generally circular hole.

The assembly 10 further includes a male exterior shield 34, hereafter referred to as the male shield 34. The male shield 34 is adapted to be connected to the female shield 22 and is sized to closely fit within the open end 28 of the female shield 22. The male shield 34 is formed from a sheet of a metallic material, such as C110 copper alloy by stamping and bending the male shield 34 to the desired shape. The male shield 34 may also be plated, such as with a tin-based plating, to enhance corrosion resistance. The male shield 34 defines a plurality of flexible contacts 36 that is adapted to closely engage and contact an interior surface 38 of the female shield 22, thereby providing an electrical connection between the female shield 22 and the male shield 34. At least a pair of flexible contacts are disposed in opposite side walls of the male shield. Due to perspective of the drawings in FIGS. 1-3, the second flexible contacts in the opposite side wall are not visible. The free end 42 is configured to contact the female shield 22. Other types of flexible contacts 36 that are well known to those skilled in the art could alternatively be used. The flexible contacts 36 may be formed during the stamping and bending processes.

As best shown in FIG. 3, the male shield 34 additionally defines a pair of flexible protrusions 44 in opposite side walls of the male shield 34 and as best shown in FIG. 2 are generally orthogonal to the flexible contacts 36. The flexible protrusions 44 are designed to align with and snap into the apertures 30, thereby providing a mechanical connection between the female shield 22 and the male shield 34. This mechanical connection between the flexible protrusion 44 and the aperture 30 at least provides the benefit of inhibiting micro-motion between the female shield 22 and the male shield 34 caused by mechanical shock or vibration, thereby reducing the likelihood of fretting corrosion occurring between the female shield 22 and the male shield 34.

The flexible protrusions 44 in the instant example include a generally circular convex bump 46 that is designed to align with and snap into the aperture. The convex bump 46 may be characterized as having a hemispherical or partially spherical shape. The flexible protrusions 44 also include a flexible fixed beam 48 on which the convex bump 46 is disposed. The beam 48 may be formed removing a portion of the male shield 34 on each side of the beam 48 during the stamping process and the convex bump 46 may be formed by embossing a portion of the beam 48, also during the stamping process.

The male shield 34 is sized to closely fit within an interior cavity 50 formed by the open end 28 of the female shield 22. The flexible protrusions 44 are sized to mechanically interfere with the female shield 22 when they are in a non-flexed condition. Without prescribing to any particular theory of operation, when the male shield 34 is inserted into the cavity 50 of the female shield 22, the leading edge of the bump of the flexible protrusion contacts the inner surface of the female shield 22. The beam 48 flexes inward until the apex of the convex bump 46 contacts the interior surface 38. As the male shield 34 is further inserted into the female shield 22, the bump aligns with the aperture and the beam 48 flexes outward snapping the bump into the aperture.

The flexible protrusions 44 flex along axis B and the flexible contacts 36 flex along axis C. Axes B and C are generally orthogonal to one another, and so the flexible protrusions 44 interact with the female shield 22 substantially independently of the flexible contacts 36.

The assembly 10 further includes an electrical terminal 52 that is connected to the inner core 14 of the electrical cable 12. The electrical terminal 52 in the instant example is a female terminal having a terminal insert 54. The female terminal is configured to mate with a male blade terminal (not shown). The electrical terminal 52 is enclosed within the female shield 22 and the male shield 34. Alternative embodiments of the assembly may use another electrical terminal type as is well known to those skilled in the art.

The assembly 10 also includes a dielectric insulating member 56, hereafter referred to as the insulator 56. The insulator 56 is disposed within the male shield 34. The insulator 56 is configured to electrically isolate the electrical terminal 52 from the male shield 34 and to mechanically support and secure the electrical terminal 52 within the male shield 34. The insulator 56 defines cutouts 58 that allow the flexible protrusions 44 to flex inward. The male shield 34 may also define features, such as inward protrusions 60, that are configured to secure the insulator 56 within the male shield 34.

The assembly 10 additionally includes an insulative connector body 62 that is configured to be connected to another connector body (not shown) that contains the mating terminal for the electrical terminal 52. The male shield 34 defines a plurality of tabs 64 that are configured to engage the connector body and secure the male shield 34 within the connector body. The male shield 34 also defines a plurality of contacts 66 that are configured to provide an electrical connection between the male shield 34 and electrical conductors in the connector body 62.

The non-limiting examples of the electrical cable assembly 10 shown in FIGS. 1-3 include a female shield 22 and a male shield 34 having a generally rectangular shape and multi-strand cable to be used in a high voltage/high current application. It should be understood that other embodiments of the assembly 10 are envisioned that include shields having square or circular shapes. Alternatively, the electrical cable may have a single solid conductor or, such as a coaxial cable or may have multiple separately insulated conductors within an outer sheath 18, such as a twin axial cable and may be used for analog or data communication applications. Still alternatively, the male shield 34 may be connected to an outer sheath 18 of another electrical cable 12.

Accordingly, an electrical cable assembly 10 is provided. The electrical cable assembly 10 includes a male shield 34 and a female shield 22 that is configured to connect to the outer sheath 18 of a shielded electrical cable 12 in order to maintain electrical continuity of the shield across a connection of the inner core 14 of the shielded electrical cable 12. The male shield 34 includes a flexible protrusion that snaps into an aperture in the female shield 22 to mechanically connect the female shield 22 and the male shield 34 to one another. The male shield 34 also includes a flexible contact that is generally located orthogonal to the flexible protrusion and provides an electrical connection between the female shield 22 and the male shield 34. Because the location of the flexible protrusion and the flexible contacts 36 are orthogonal, the forces exerted by the flexible protrusion on the female shield 22 and the male shield 34 are substantially independent of the forces exerted by the flexible contact on the female shield 22 and the male shield 34.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. An electrical cable assembly comprising:

an electrical cable having an inner core and a surrounding outer sheath each running the length of the electrical cable;

a female exterior shield that is connected to the outer sheath at a closed end, having an open end defined about a central axis, and defining an aperture having an aperture axis generally perpendicular to the central axis; and a male exterior shield adapted to be connected to said female exterior shield and sized to fit within said open end of the female exterior shield, wherein the male exterior shield defines a flexible contact adapted to closely engage an interior surface of the female exterior shield, thereby providing an electrical connection between the two shields, wherein the male exterior shield defines a flexible fixed beam defining a convex bump that is designed to align with and snap into the aperture, thereby providing a mechanical connection between the two shields, and wherein the flexible fixed beam and the flexible contact flex along axes that are generally orthogonal to one another so as to interact with the female exterior shield substantially independently of one another.

2. The electrical cable assembly of claim 1, wherein the aperture is characterized as a generally circular hole in a side wall of the male exterior shield.

3. The electrical cable assembly of claim 2, wherein the convex bump is characterized as a generally circular convex bump.

4. The electrical cable assembly of claim 1, wherein the female exterior shield defines a pair of apertures located one opposite the other and sharing the aperture axis and wherein the male exterior shield defines a pair of flexible fixed beams each defining a convex bump designed to align with and snap into the pair of apertures.

5. The electrical cable assembly of claim 4, wherein the male exterior shield defines a pair of flexible contacts located one opposite the other.

6. The electrical cable assembly of claim 1, further including an electrical terminal connected to the inner core.

7. The electrical cable assembly of claim 6, further including a dielectric insulating member disposed between the electrical terminal and the male exterior shield.

8. The electrical cable assembly of claim 7, further including a connector body in which the two shields are disposed.

* * * * *